US011149397B2

(12) United States Patent
Smith

(10) Patent No.: US 11,149,397 B2
(45) Date of Patent: Oct. 19, 2021

(54) SIDE LOADED REMEDIATION METHOD AND APPARATUS FOR REINFORCED CONCRETE PILINGS

(71) Applicant: Basalt World Corp., Pompano Beach, FL (US)

(72) Inventor: Donald R. Smith, Pompano Beach, FL (US)

(73) Assignee: Basalt World Corp., Pompano Beach, FL (US)

( * ) Notice: Subject to any disclaimer, the term of this patent is extended or adjusted under 35 U.S.C. 154(b) by 0 days.

(21) Appl. No.: 16/707,767

(22) Filed: Dec. 9, 2019

(65) Prior Publication Data

US 2021/0172144 A1 Jun. 10, 2021

(51) Int. Cl.

| | |
|---|---|
| ***E04C 5/01*** | (2006.01) |
| ***B28B 23/02*** | (2006.01) |
| ***E02D 5/64*** | (2006.01) |
| ***E02D 37/00*** | (2006.01) |

(52) U.S. Cl.

CPC ..... *E02D 5/64* (2013.01); *E02D 37/00* (2013.01); *E02D 2250/0007* (2013.01); *E02D 2250/0023* (2013.01); *E02D 2300/001* (2013.01); *E02D 2300/002* (2013.01); *E02D 2300/0006* (2013.01); *E02D 2300/0014* (2013.01); *E02D 2300/0051* (2013.01); *E02D 2300/0054* (2013.01); *E02D 2300/0068* (2013.01)

(58) Field of Classification Search

CPC ... E02D 5/64; E02D 37/00; E02D 2300/0068; E02D 2300/0054; E02D 2300/001; E02D 2300/0014; E02D 2300/0006; E02D 2300/002; E02D 2250/0007; E02D 2250/0023; E02D 2300/0051

See application file for complete search history.

(56) References Cited

U.S. PATENT DOCUMENTS

| | | | | | |
|---|---|---|---|---|---|
| 2,080,999 | A * | 5/1937 | Cooney | E03F 3/04 | 138/100 |
| 2,425,079 | A * | 8/1947 | Billig | B63B 3/62 | 52/88 |
| 3,505,825 | A * | 4/1970 | Colby | E02D 5/64 | 405/223 |
| 3,937,372 | A * | 2/1976 | Bode, Jr. | B22D 41/38 | 222/600 |
| 4,494,576 | A * | 1/1985 | Buttner | E04C 5/0613 | 138/175 |
| 4,797,037 | A * | 1/1989 | Hong | E02D 5/523 | 405/232 |

(Continued)

*Primary Examiner* — Edwin J Toledo-Duran

(74) *Attorney, Agent, or Firm* — McHale & Slavin, P.A.

(57) ABSTRACT

A method of rehabbing reinforced concrete pilings while in service and without the requirement to demo or otherwise gain access over the ends of an existing column. Design adopts modern environmentally responsible fiber reinforced polymer rebar and other FRP stirrups uniquely shaped into spiral sections requiring only side access for placement, designed to permanently encase the piling with a totally non-rusting non-metal reinforcement lateral containment cage featuring preformed circumference stirrups that mechanically interlock vertically and lateral adjustability to control density. The spiral stirrups extending fully 360-degrees around an existing piling with an additional overlap of at least 45 degrees.

14 Claims, 11 Drawing Sheets

(56) References Cited

U.S. PATENT DOCUMENTS

| | | | | |
|---|---|---|---|---|
| 4,918,891 | A * | 4/1990 | Gerszewski | E02D 27/02 52/125.4 |
| 5,263,292 | A | 11/1993 | Holland et al. | |
| 5,469,679 | A | 11/1995 | Burkard et al. | |
| 5,599,599 | A * | 2/1997 | Mirmiran | B29C 70/865 428/120 |
| 5,836,715 | A * | 11/1998 | Hendrix | B29C 70/222 404/134 |
| 6,263,629 | B1 * | 7/2001 | Brown, Jr. | E04C 2/044 442/179 |
| 7,073,980 | B2 * | 7/2006 | Merjan | E02D 5/28 405/231 |
| 7,421,827 | B1 * | 9/2008 | Konstantinidis | E04C 5/0604 52/252 |
| 9,890,546 | B2 * | 2/2018 | Ehsani | E04G 23/0225 |
| 9,963,318 | B1 * | 5/2018 | Robbins | B65H 43/06 |
| 10,118,314 | B1 * | 11/2018 | Robbins | B28C 7/16 |
| 2009/0145074 | A1 * | 6/2009 | Tsukamoto | E04C 5/07 52/686 |
| 2013/0014468 | A1 * | 1/2013 | Ehsani | E04C 5/07 52/741.3 |
| 2013/0097955 | A1 * | 4/2013 | Carson | E04C 5/012 52/309.16 |
| 2017/0203496 | A1 * | 7/2017 | Ehsani | B29C 63/0073 |
| 2019/0032346 | A1 * | 1/2019 | Ehsani | E04G 13/023 |
| 2019/0226206 | A1 * | 7/2019 | Yin | E04C 2/06 |
| 2019/0226210 | A1 * | 7/2019 | Yin | E04C 3/293 |

* cited by examiner 118
116

122
120

110
22
24
20
10
18
12
16
14
100

112
114

SIDE LOADED REMEDIATION METHOD AND APPARATUS FOR REINFORCED CONCRETE PILINGS

CROSS REFERENCE TO RELATED APPLICATIONS

Not Applicable

FEDERALLY SPONSORED RESEARCH OR DEVELOPMENT

Not Applicable

FIELD OF THE INVENTION

This invention relates to pilings constructed from reinforced concrete, and more particularly, to apparatus and method for rehabbing steel reinforced pilings and or columns.

BACKGROUND OF THE INVENTION

RC, reinforced concrete, pilings are commonly used in construction as foundation support structures. Unfortunately, the pilings are susceptible to degradation over time for many reasons, one of which is that concrete is porous and subject to wicking in moisture all the way inside to the steel reinforcement. Another issue is caused in that steel and concrete have different coefficients of expansion, leading to cracks that directly expose the underlying steel reinforcement bars. Time has proven these micro cracks help accelerate, among other things, alkali silicate reaction (ASR) which is a chemical reaction between unstable silica mineral phases from aggregates used in the concrete and alkali ions found in the concrete pour solution. ASR is by far the most common destructive reaction mechanism found in concrete around the world. Another early demise of steel reinforced concrete piling is their prevalent use in saltwater applications. To delay the onset of serious rust and corrosion and to extend the useful service life of black steel reinforced concrete the alkalinity value of concrete containing steel reinforcement must maintain the steel passivating condition of high 13-14 pH. Unfortunately, the porous nature of concrete allows wicking of moisture wherein the mineral content of the water and concrete ultimately forms an electrolyte with a lower PH that reacts with the reinforcing steel setting up an electrochemical (galvanic) reaction between embedded steel and the subsequent corrosion of the steel results in swelling of the steel reinforcement often manifesting in the form of concrete spalling (splitting open) or complete structural support failure. Pilings found in saltwater applications may be used to uphold pier and dock structures, waterway sign supports, highway bridge supports and so forth. Due to known degradation of the steel reinforced concrete pilings, many marine applications choose wood pilings, which have no steel and thus cannot rust. However, wood pilings are subject to wood rot and marine infestation, making them inadequate for most construction foundations.

Since concrete is strong in compression, but relatively weak in tension, all concrete pilings installed to date are reinforced with steel bar. In RC Reinforced Concrete reinforcement bar, commonly referred to as rebar, when cast into a piling during the manufacturing step, rebar placement is calculated to carry the tensile structural load. Rebar largely compensates for the imbalance of compression and tension therefor it is imperative rebar remain in sound condition throughout the service life of the piling. Unfortunately, the penetration of saltwater into porous concrete steel reinforced pilings results in corrosion of the rebar, which leads to the degradation of the piling.

Saltwater, which makes up 97 percent of all the water on earth, has a high NaCl (sodium chloride) salinity which creates an electrolyte corrosive to unprotected steel. Since the electrolyte has only a short distance to travel through concrete to reach the steel rebar, constant exposure to saltwater expedites the corrosion of the rebar. The pilings of critical concern are those that are directly affected with saltwater, especially areas that have tidal changes.

Concrete pilings come in a variety of shapes; square being a desirable shape as it allows for ease of manufacturing and storing, wherein the shape does not allow rolling and can be easily stacked. A circular shape is more difficult to store but allows for equal bending strength in all directions. The problem with concrete pilings, which this invention addresses, is the recognition that the vast quantity of concrete pilings installed in saltwater environments are now failing. The cost to replace the concrete pilings can be prohibitively expensive, especially when the pilings are used as support to a superstructure, which would have to be removed if the pilings are replaced. It is recognized that the ends of the steel rebar are especially prone to moisture ingress and wicking between the rebar and the concrete as a result accelerated failure is exacerbated when rebar is cut to meet a particular application. Thus, despite the improvements in coating of steel rebar, the experience of time has now proven, should the steel rebar be cut or the coating on steel be damaged, just a few chips, nicks and or scratches, serve as points of continuity for the moisture to act as electrolyte in contact with the steel setting up galvanic action, saltwater will concentrate at the damage sites and cause the steel rebar to fail even more rapidly.

Known attempts have been proposed to extend the life of black steel rebar in concrete, such as hot dip galvanizing the steel, which is a zinc coating metallurgically bonded to the steel. However today there are concerns about the leaching of lead and other heavy metals into our water table. U.S. Pat. No. 5,263,292 discloses a post-tensioned anchor assembly having an anchor and a steel tendon affixed within the anchor. The tendon is protected by a cap made of an anodic material, such as zinc or magnesium, which covers the end of the tendon. U.S. Pat. No. 5,469,679 discloses a protective sealing cover made of flexible material for easy application over an exposed end of cut reinforcing bar. The protective sealing contains a water impermeable sealant which surrounds the end of the reinforcing bar for protection against corrosive agents.

However, steel rebar expands and contracts at an expansion ratio that is different than concrete. The cycling assists in the opening of micro cracks, which allow water intrusion that can reach the steel rebar. Steel rebar typically includes surface deformations to improve bonding with concrete. Due to the strong bond, the concrete effectively transfers stresses to the steel and vice versa. Unfortunately, while the bond initially provides a superior reinforced concrete, as Portland based concrete cures it shrinks, the close bond coupled with steels higher thermal expansion can also cause the cracking in concrete since the concrete will eventually lose its elasticity to follow said thermal expansion/contraction. The concrete can then move over the steel causing damage to a coated steel rebar leading to accelerated corrosion. While high pH cement paste can be used to help form a non-reactive surface film to inhibit corrosion, this passivation process is not effective if the steel is exposed to the electrolyte action caused by saltwater.

All steel reinforced concrete pilings are subject to structural integrity failure upon degradation of the steel reinforcing rebar. The question is not a matter of if the piling will have an integrity problem; the question is when the integrity problem will occur. To postpone the onset of failure, concrete pilings require continuous and costly maintenance.

Pilings are used for support of structures such as bridges, piers, docks, boat lifts and so forth, wherein the structure is secured to the top of the piling. Replacement of a piling requires removal of the structure it supports or at a minimum separation at the top to allow access. Not only is this expensive, it can be structurally impossible.

Thus, what is needed in the industry is an apparatus and method for remediation (rehabilitating) concrete pilings while they are still in place with no ability to install new fully circular reinforcement for lateral containment using traditional methods.

SUMMARY OF THE INVENTION

Considering the above and according to one aspect of the invention, disclosed herein is a reinforcement apparatus and method to rehabilitate many sizes and shapes of concrete, reinforced concrete (RC), steel, wood and plastic pilings with a fiber reinforced polymer (FRP) apparatus and method. While basalt fiber reinforced polymer (BFRP), a glass state continuous basalt fiber reinforcement is, by virtue of its superior performance relative to cost and significantly lower carbon footprint the preferred FRP material, and is used as the primary embodiment throughout this disclosure, the apparatus and method taught may also work with the manmade recipe for a Glass Fiber Reinforced Polymer (GFRP), Carbon Fiber Reinforced Polymer (CFRP), Aramid Fiber Reinforced Polymer (AFRP), or Hemp Fiber Reinforced Polymer (HFRP).

During its initial construction, as new, or in remediation, the FRP longitudinal bars (rebars) are evenly positioned around a piling as part of a cage designed to contain lateral displacement of the concrete under compressive loads. Where top and bottom access is not possible, one convenient method of constructing a support cage begins by temporarily tying said longitudinal reinforcement rebars to the piling for remediation. Lateral supports arrive composed of stiff FRP shaped preformed into interlocking spiral sections. By design said preformed spirals will easily twist pass said longitudinal rebars and past the existing pile being remediated with little or no bending force. Once rotated into position said spiral wraps are self-centering around the piling and serve to evenly space and align the longitudinal FRP rebar as they are each tied to said lateral support spirals. The resulting assembly forming a non-metallic, corrosion proof, continuous wrap FRP cage with optimized straight-line point-to-point loading. To provide adjustability in both containment length and containment density, said preformed spiral shaped sections interlock to each other vertically. By design each FRP spiral divides lateral containment loads into two separated parallel paths stabilized by integral cross bracing. Vertical connections overlap with male-female end to end connections placed to straddle the longitudinal rebar itself which then serves to pin spiral sections end to end providing 360-degree continuity of lateral containment forces. By design, spiral connections stagger and overlapped in a manner enabling the load capacity of said spiral connections to exceed that of the containment spiral itself. In this way lateral containment can be extend over any length of the piling as required. Preferably said spirals are placed covering the piling from bottom to a top, or at least a position well above and below the expected high tide water level. An enclosure commonly referred to as a form is positioned around the FRP assembly and filled with concrete to permanently encase the structure. The structural integrity of this design does not require forms remain in place, rather often today these forms are available in light weight reusable plastic.

The extremely high tensile strength, low stretch and cyclical tenacity of continuous basalt fibers produce a reinforcing structure with a total weight perhaps only $1/5^{th}$ that of steel, yet can never rot, rust, or otherwise disintegrate, the preferred embodiment of said system adopts thermoset bio epoxy making it the lowest carbon footprint reinforcement for concrete available. The continuous basalt fiber reinforcing bar and cage is formed from a method that sets basalt fibers with a thermoplastic or thermo set polymer selected from the group comprising urethane, polyester, vinyl ester, epoxy, bio epoxy, phenolic, polyimide, polyamide, polypropylene, PEEK, methacrylate, or a combination thereof and all of which can be graphene and or Nano enhanced. The basalt fibers are placed in position, either straight or curved, wherein the fibers are fixed in position once the polymer solidifies. Unique to this cold forming is that useful diameter bar sizes of the fully cured basalt/resin matrix can be stored and shipped in a rolled or coiled position and will never take a set other than how it was formed during initial curing. Should the basalt rebar be stored in a wrapped position, upon removal from the wrap, the basalt rebar will return to the formed straight position. If the basalt rebar is formed in a curved position, should the rebar be placed into a straightened position, the rebar will seek it original curved formation. The continuous basalt fibers are formed from a specified number of multiple roving (bundles) to consistently produce the required strength for the load predictions in a similar manner to steel calculations. The micron size of the continuous basalt fiber tendons and the text (denier) size of the continuous basalt fibers roving may be altered as necessary to achieve structural BFRP reinforcements that include optimal performance cost considerations.

A benefit of using continuous basalt fiber is that, in the event of a onetime catastrophic overload, the continuous basalt fiber reinforcement does not exhibit memory for the event, and the tenacity of continuous basalt fiber reinforced concrete will likely return to its original condition and shape. A catastrophic overload on a concrete structure properly reinforced with BFRP will result in of the concrete failing in crush which may be repairable. With steel rebar catastrophic overload would exhibit bend, stretch, deformation memory and permanently impart forces on the concrete that serve to spread and permanently deform the RC structure requiring demo and replacement of the RC structure. Continuous basalt fiber is manufactured from basalt filament tendons made by melting crushed naturally occurring and renewable volcanic rock of a specific mineral mixture, known as breed, and drawing (stretching) and cooling to solidify the molten material into fiber tendons normally tuned to be in the most favorable range of 9 to 21 micron. Said drawing and cooling process avoids any dwell time at temperatures that could possibly form crystals thereby insuring highly durable continuous "glass-state" fibers largely free of inclusions resulting in a plurality of Eco-friendly structural filament tendons together having a low stretch perfectly matching that of concrete, extremely low if any creep rupture and substantially higher tensile strength than steel of the same diameter at one fifth the weight and basalt fiber being a "glass-state" structural material virtually corrosion free.

In an embodiment, the invention discloses the formation of a continuous filament FRP stirrup for the reinforcement of concrete in which the construction of said stirrup is a layer wound continuous loop build up to achieve strength, size and shape negating the possibility of secondary bond shear by the possibility of producing said part using only one continuous fiber of roving bundle, one beginning and one end.

An objective of the present invention is to provide an FRP apparatus and method of construction that provides an economical way of rehabilitating and reinforcing concrete piling employing side and or compressive loading so as not to disturb the existing supported structure.

Another objective of the present invention is to provide a concrete piling reinforcement with a polymer matrix that is reinforced and cannot rust and will not absorb or wick water.

Still another objective of the present invention is to provide a basalt material for use in combination with cement materials hydrated with saltwater aka Sea Create™ to provide both new Eco-Friendly RC infrastructure and the ability to cost effectively preform practical remediation that will significantly extend the service life of a steel reinforced concrete structure.

Yet still another objective of the present invention is to provide a basalt matrix reinforcement which is relatively light weight compared to metal reinforcements, thus reducing shipping costs, logistics issues, and lateral sheer within a concrete matrix induced by reinforcement displacement of the concrete in plane.

Still another objective of the invention is to provide an assembly that a worker can safely lift without the need for mechanical leverage or addition assistance from other workers.

Still another objective of the invention is to provide tensile and shear reinforcement to concrete that resists wicking of moisture.

Yet another objective of the present invention is to provide a concrete reinforcement matrix that has the same thermal coefficient of expansion as concrete and is naturally resistant to corrosion, rust, alkali, and acids.

Still yet another objective of the present invention is to provide a concrete reinforcement matrix that does not conduct electricity and will not create an electrical path for through the concrete.

Still yet another objective of the present invention is the ability to add extremely low thus cost-effective amounts of graphene to the resin matrix making it possible to externally scan for the exact placement of glass state FRP reinforcements within finished concrete structure.

Still yet another objective of the present invention is to provide a concrete reinforcement matrix that does not allow the creation of magnetic fields thereby enhancing the transparency of BFRP reinforced concrete to magnetic, FR and microwave.

Yet another objective of the present invention is to extend the service limits of thermal load limits of a concrete steel reinforced support structure.

Yet still another objective of the present invention is to enhance the cyclical tenacity of a concrete support structure in a seismic event.

Yet still another objective of the present invention is to provide a concrete reinforcement matrix having similar strength properties to that of steel, but weighs one fifth the amount of steel, and can be cut in the field with a conventional saw.

Another objective of the present invention is to provide a piling reinforcement that increases the PSI rating level of concrete to be sufficient to withstand higher weight bearing loads, wherein basalt can be exposed to high salinity water without being weakened.

Yet another objective of the invention is to convert a square piling into a circular piling, allowing ease of wrap attachments, and providing the benefit of a support structure that distributes stress evenly over a 360-degree diameter quite possibly increasing the service load capability of concrete piling.

Still another objective of the invention teaches a method to continuously wind a double bar spiral stirrup that inherently returns to its intended shape without memory for overload damage during transportation and or installation.

Yet another objective of this invention adopts a double bar stirrup with integral cross bracing to ensure reinforcement spacing and inherently mitigate the possibility of lateral cracking between parallel stirrup bars.

Another objective of the invention is to teach efficient use of FRP systems stronger than steel at approximately $1/5^{th}$ the physical weight, infinitely scalable in size and strength, simple design inherently controls spacing, holds longitudinal rebar properly positioned quickly forming a simple strong and tenacious lateral containment cage. In the preferred embodiment both FRP longitudinal bars (rebar) and spiral stirrups can be constructed of naturally renewable volcanic basalt rock processed into a code approved continuous glass state basalt fiber, aka BFRP. The preferred embodiment features bio epoxy with or without graphene and or Nano enhancements. Designed is self-centering with reusable plastic forms for concrete placement in mind.

Still another objective is to provide an apparatus and method of tooling for the production of the FRP spiral containments that allows adjustment to control the width of the spacing between the parallel bar sections of the spiral cage assemblies of FRP reinforcement, providing a method to provide installers with control over the shear strength with the reinforced concrete piling itself.

And still another objective of the invention is to teach a method that allows the material to be wound in both clockwise and counterclockwise directions making it possible to produce a biaxial containment reinforcement cage.

Other objectives and further advantages and benefits associated with the basalt rebar matrix will be apparent to those skilled in the art from the description, examples and claims which follow.

DETAILED DESCRIPTION

Figure 1:
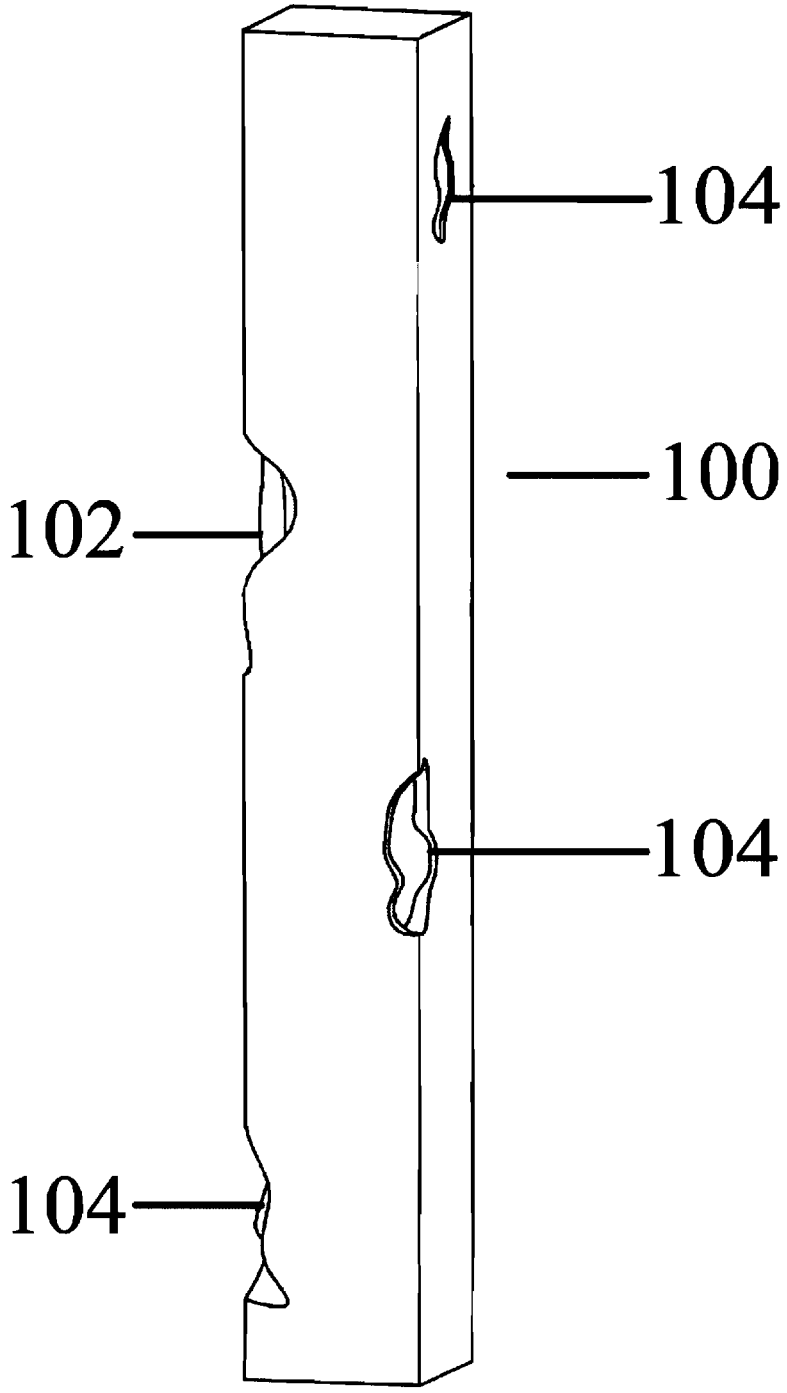
FIG. 1 is a pictorial illustrating a piling in need of repair or replacement.
Figure 3:
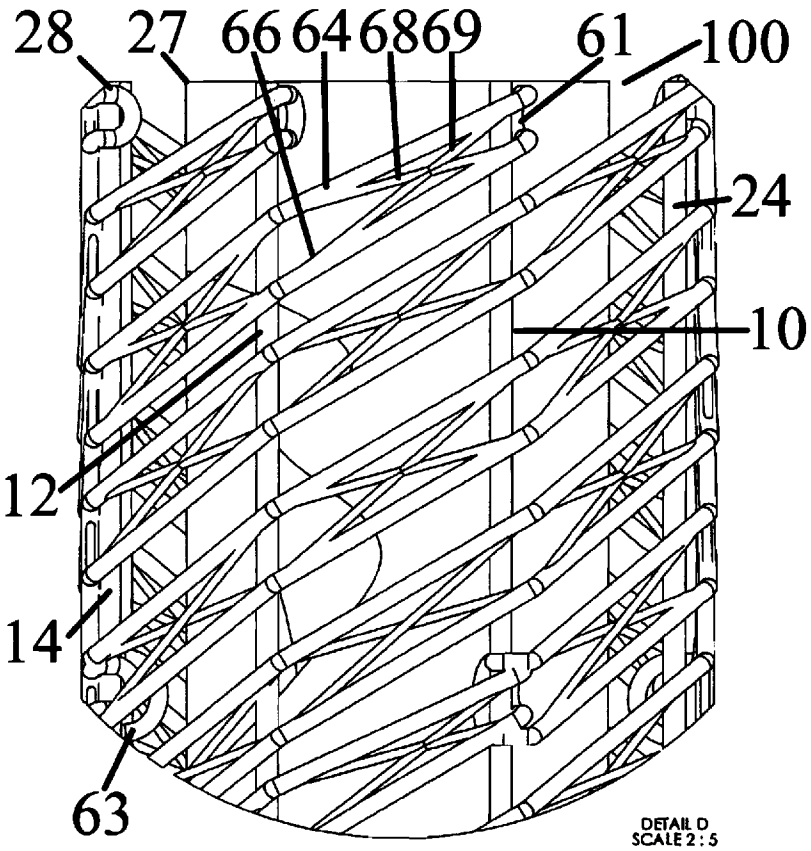
FIG. 3 is an enlarged section of FIG. 2.
Figure 2:
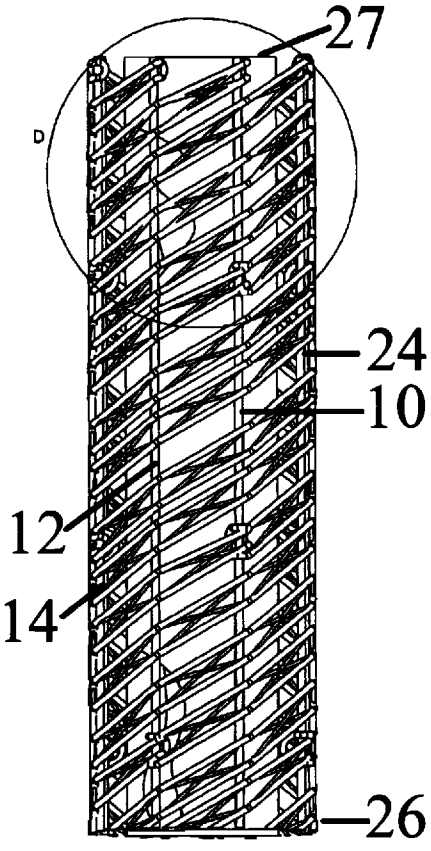
FIG. 2 is a side view of the basalt assembly that can be place around an existing piling without forceful bending.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIG. 1 is a pictorial of a concrete piling 100 reinforced with steel rebar 102 in a state of disrepair as evident by spalling 104, resulting in displaced concrete that has broken off. The concrete piling 100 is illustrative of a support used for a pier or a bridge. Typically, when a piling reaches this state of disrepair, the piling would likely become compromised and scheduled to be replaced. However, support structures are not simply replaced if the supported structure is a pier, roadway, boat lift, bridge or the like. The method of rehabilitation eliminates the need for replacing concrete pilings by use of an apparatus and method to rehabilitate the piling without disturbing the structure supported by the pilings.

While glass-state continuous basalt fiber produced from naturally occurring and renewable resources is the preferred material, and used as the primary embodiment throughout this disclosure, the apparatus and method is based upon Fiber Reinforced Polymer (FRP), such as the more common E electric and CR corrosion resistant man-made recipes for silicate based fiberglass aka (GFRP). Alternatively, the material can be manufactured from Carbon Fiber Reinforced Polymer (CFRP), Aramid Fiber Reinforced Polymer (AFRP), or Hemp Fiber Reinforced Polymer (HFRP). Basalt is a preferred material, basalt is a nontoxic naturally occurring volcanic rock that, when processed into continuous "glass-state" fibers, can be subsequently bundled into pliable roving's that may be cold formed into longitudinal or shaped reinforcement bars. All FRP materials have a variety of benefits when compared to steel rebar, which is typically used for reinforced concrete. Basalt is a naturally occurring rock which cannot rust once processed into a "glass-state" basalt cannot develop any type of corrosion and cannot absorb water. Basalt rebar is also about one fifth the weight of steel rebar, which makes basalt rebar much easier to transport and assemble on the job site. Also, basalt rebar can be easily cut using common tools in the field. Basalt can outperform concrete 10:1 in compression strength and 100:1 in tension strength. The configuration of the present invention is designed to address expansion and contraction, as well as creep and fatigue. Specifically, the invention adopts the high tensile, low stretch characteristics of continuous basalt fiber configured into a geometry that envelopes the piling only requiring side access to apply 360 degree totally non rusting structural containment to repair and rehab the piling, but also provides a support structure with superior qualities, such as allowing the support to return to its original shape after a temporary overload.

The extremely low stretch and cyclical tenacity of continuous basalt fiber is exploited to produce a reinforcing member specifically formed to provide lateral containment in both sheer and tension support for concrete. In the preferred embodiment the reinforcing members are produced using continuous basalt fibers in an appropriate adhesive matrix, be it a thermo plastic or a thermo set epoxy, vinyl ester or urethane, the reinforcing members add structural rigidity to the concrete. The continuous basalt fibers are formed from multiple roving bundles to produce the required strength using load predictions in a similar manner as to steel calculations. Continuous basalt fiber is manufactured from basalt filaments made by melting crushed volcanic rock of a specific mineral mixture known as a breed and drawing the molten material into glass-state filaments that cool to be largely inclusion free, highly durable, tenacious and resilient structural tendons having a substantially higher tensile strength than steel of the same diameter at one fifth the weight, and being virtually corrosion free.

Figure 4:
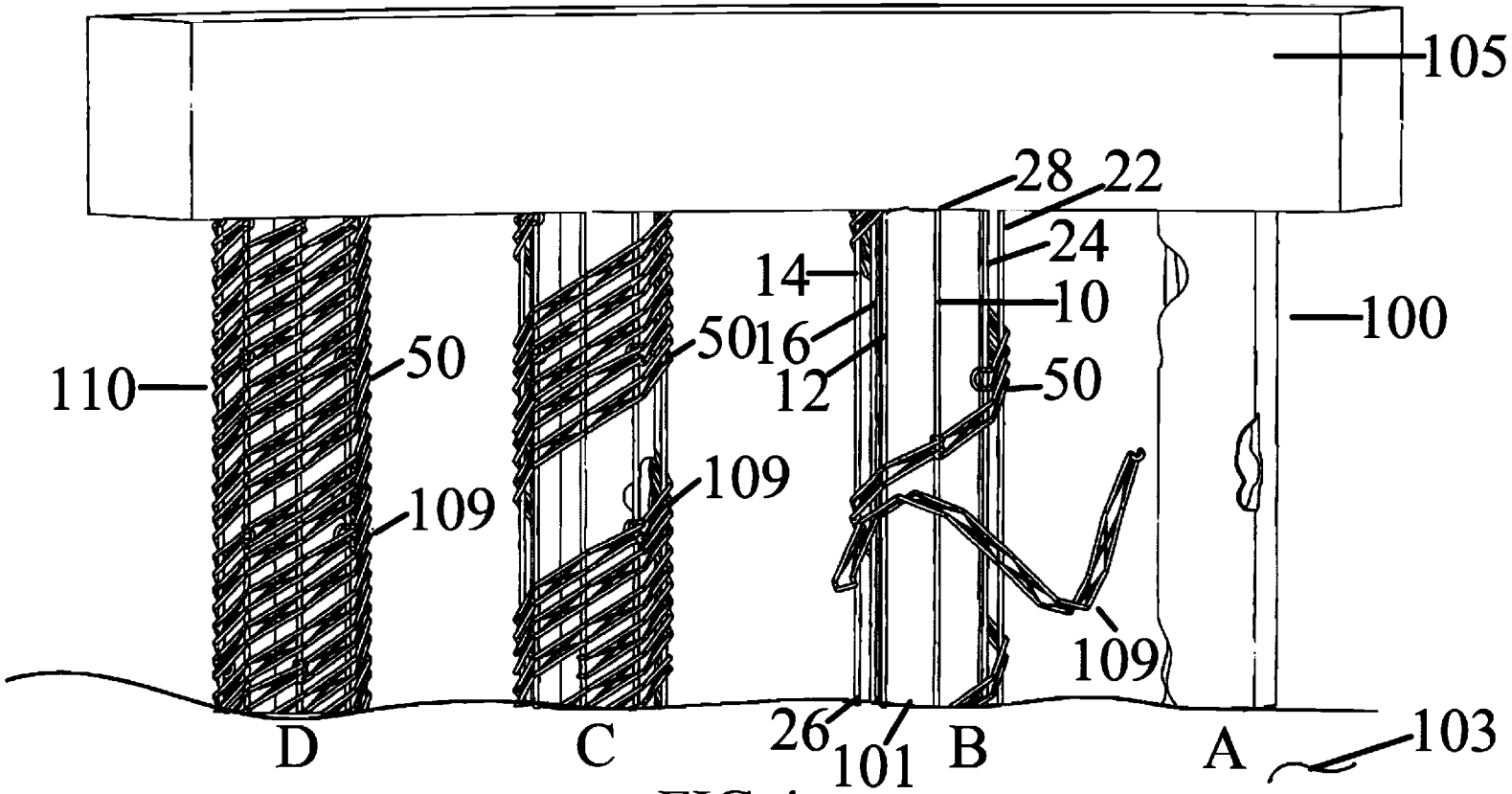
FIG. 4 is a perspective view of the basalt assembly between the earth and a supported structure.

Referring to FIGS. 2-5, in the preferred embodiment, the piling 100 is prepared with eight vertical basalt longitudinal rebars 10, 12, 14, 16, 18, 20, 22 and 24. Each longitudinal rebar is #4-12.7 mm or #5-15.87 mm in diameter, having a bottom end 26 placed near the base of the piling 101 as it is submerged in the ground layer 103. A top end 28 of each longitudinal rebar extends to a position above the expected sea level of a high tide event. FIG. 4 illustrates pilings A, B, C and D holding up a supported structure 105. Each longitudinal rebar can be cut to the proper length by a conventional saw. Unlike steel rebar, the cutting of the FRP rebar does not affect the integrity of any coating. Each FRP longitudinal bar is formed from a bundle of fibrous material admixed with a thermosetting polymer selected from the group consisting of urethane, polyester, vinyl ester, epoxy, phenolic, polyimide, polyamide, polypropylene, PEEK, methacrylate and a combination with or without graphene or Nano enhancement thereof. The fibrous material is selected from the group comprising: basalt, GFRP, CFRP, AFRP or HFRP. Piling A of FIG. 4 illustrates a piling 100 in need of rehab. Piling B of FIG. 4 illustrates a plurality of FRP REBARS 10, 12, 14, 16, and 24 placed around a piling with an FRP wrap 50 placed around the FRP bars, and FRP wrap 109 in the processing of being placed around Piling B. It is noted that the installation of the FRP wraps does not require the removal of the supported structure 105; rather, each wrap is side loaded and can cover from about 45 degrees to about 405 degrees. Piling C illustrates a majority of the FRP wraps in position in the formation of a cage 110, as further depicted by Piling D.

Figures 5, 6, 7, 8:
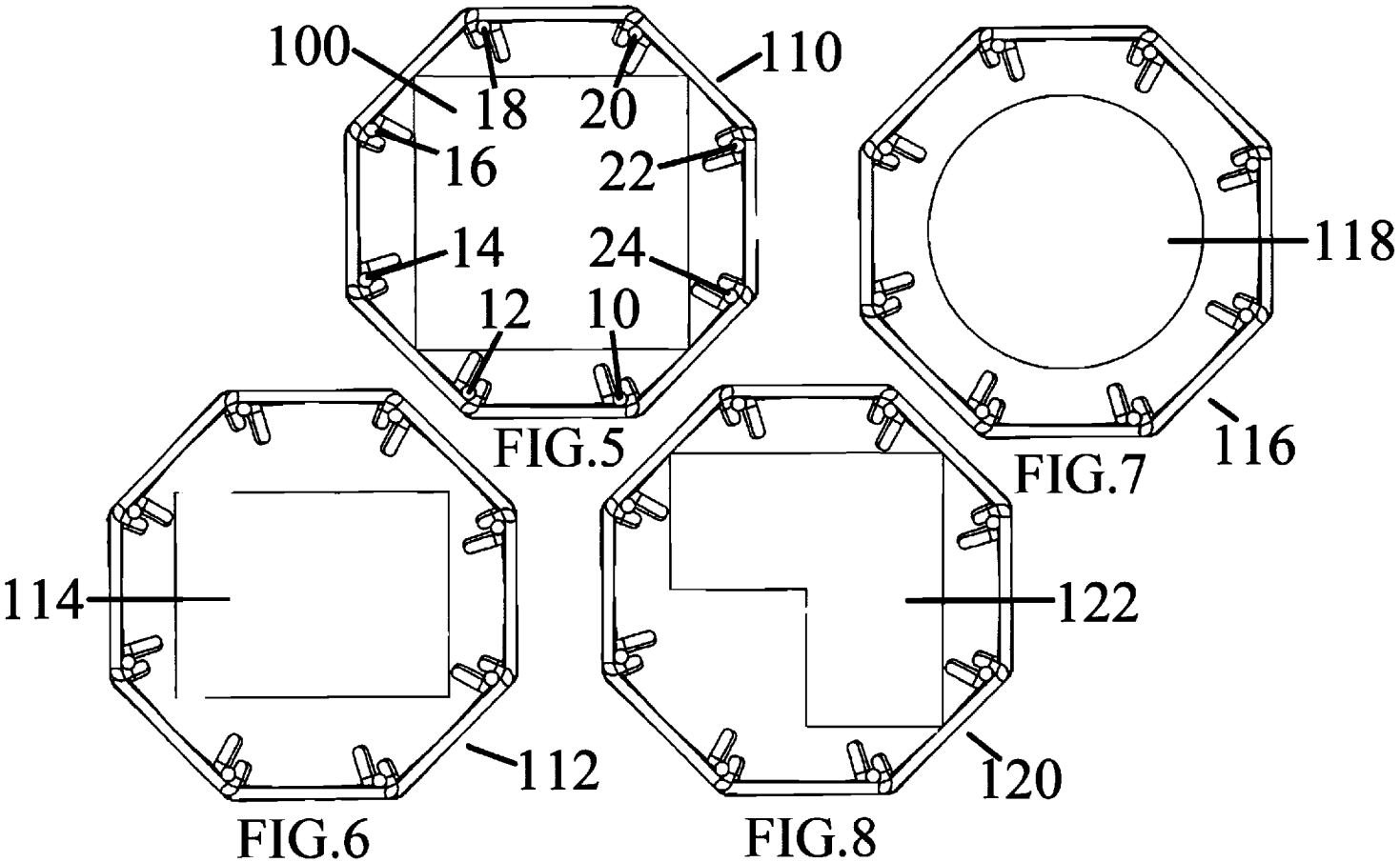
FIG. 5 is a top plane view of a cage formed around a square piling.
FIG. 6 is a top plane view of a cage formed around a rectangular shaped piling.
FIG. 7 is a top plane view of a cage formed around a circular shaped piling.
FIG. 8 is a top plane view of a cage formed around an L-shaped piling.

FIGS. 5-8 illustrate that the formation of a cage 112 which can be formed around any shape concrete piling. FIG. 5 is a top plane view of a square shaped piling 100 with the cage 110 formed around the piling. FIG. 6 is a top plane view of a cage 112 formed around a rectangular shaped piling 114. FIG. 7 is a top plane view of a cage 116 formed around a circular shaped piling 118. FIG. 8 is a top plane view of a cage 120 formed around an L-shaped piling 122.

Figure 9:
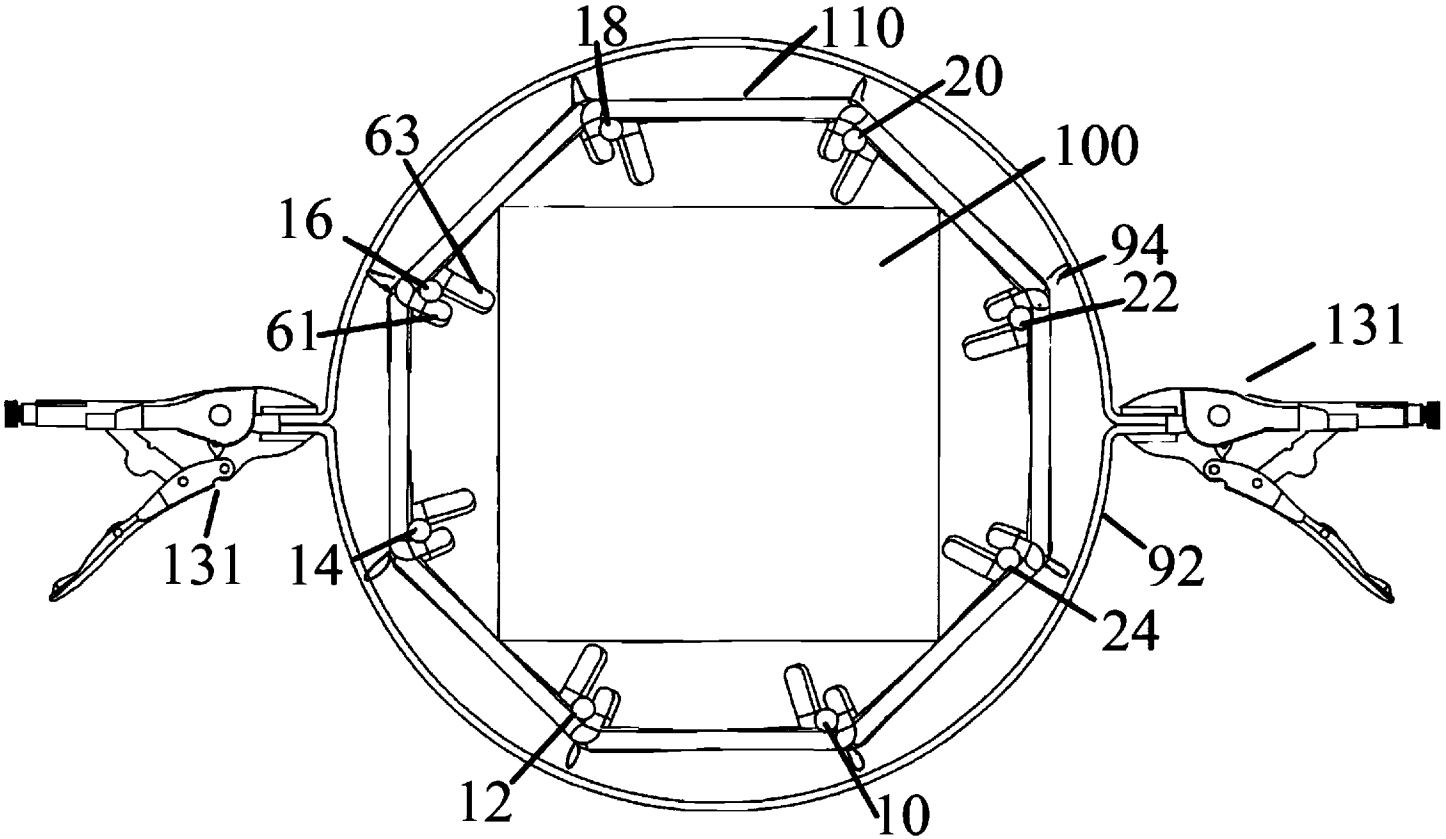
FIG. 9 is a top plane view of a cage formed around a square piling with a concrete form placed in position.

FIG. 9 is a top plane view of the piling 100 with the cage 110 formed around the square shaped piling 100 with a concrete form 92 in position. The form 92 can be held in position using vice grips 131, or the like clamps, to contain liquid cement that is filled around the piling. The wraps 50, 109 may include spacer tabs 94 to assure spacing from the inner surface of the form 92 so that the concrete fully encases the wrap. In the preferred embodiment, the FRP longitudinal rebars are defined as eight FRP longitudinal rebars spaced apart equal distances around the concrete reinforced piling to form a circular shaped envelope. In addition, each FRP wrap insertion end is spaced apart from the receptacle end a predetermined distance, allowing installation around the longitudinal rebars by rotation of the wrap during placement. In a defined embodiment, the wraps include eight sections extending from the insertion end to the receptacle end constructed and arranged to provide a full 360-degree drape plus an option ability to extend the circumference drape to overlap an additional 45-90 degree of wrap around the longitudinal rebars.

For the rehab or marine encrusted piling, all marine growth needs to be removed from the piling before placement of the cage 110. It is recommended that the cement is inserted at the lower end of the form 92 to displace all water or other containments from a bottom up arrangement. A bottom up arrangement causes displacement of water with minimal dilution of the concrete.

Figure 11:
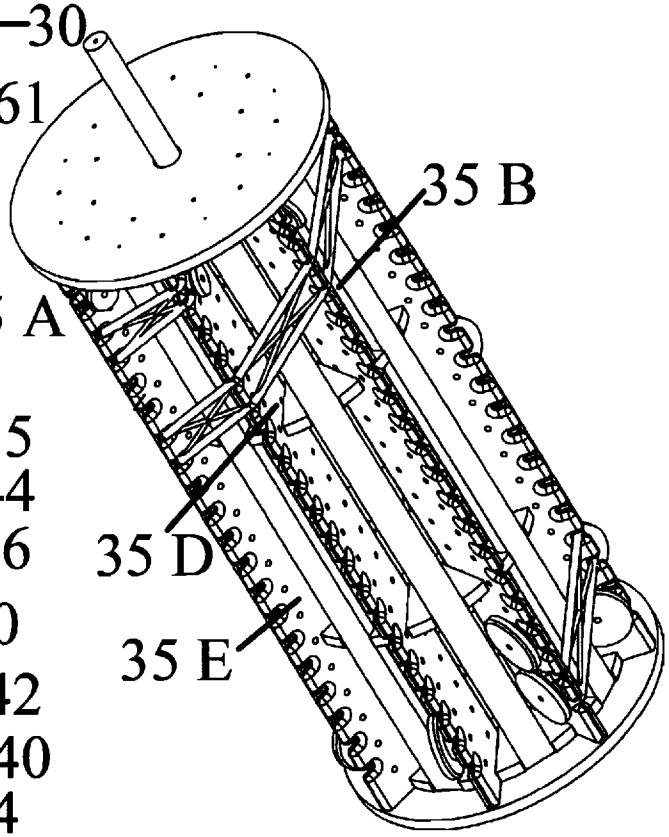
FIG. 11 is a perspective view of FIG. 10 partially rotated.
Figure 10:
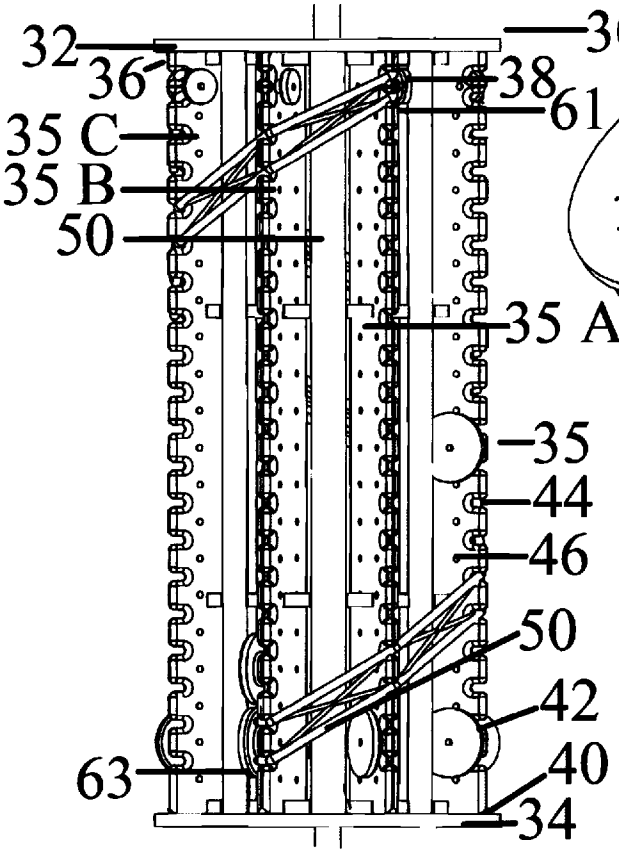
FIG. 10 is a front side view of an FRP wrap jig.
Figure 12:
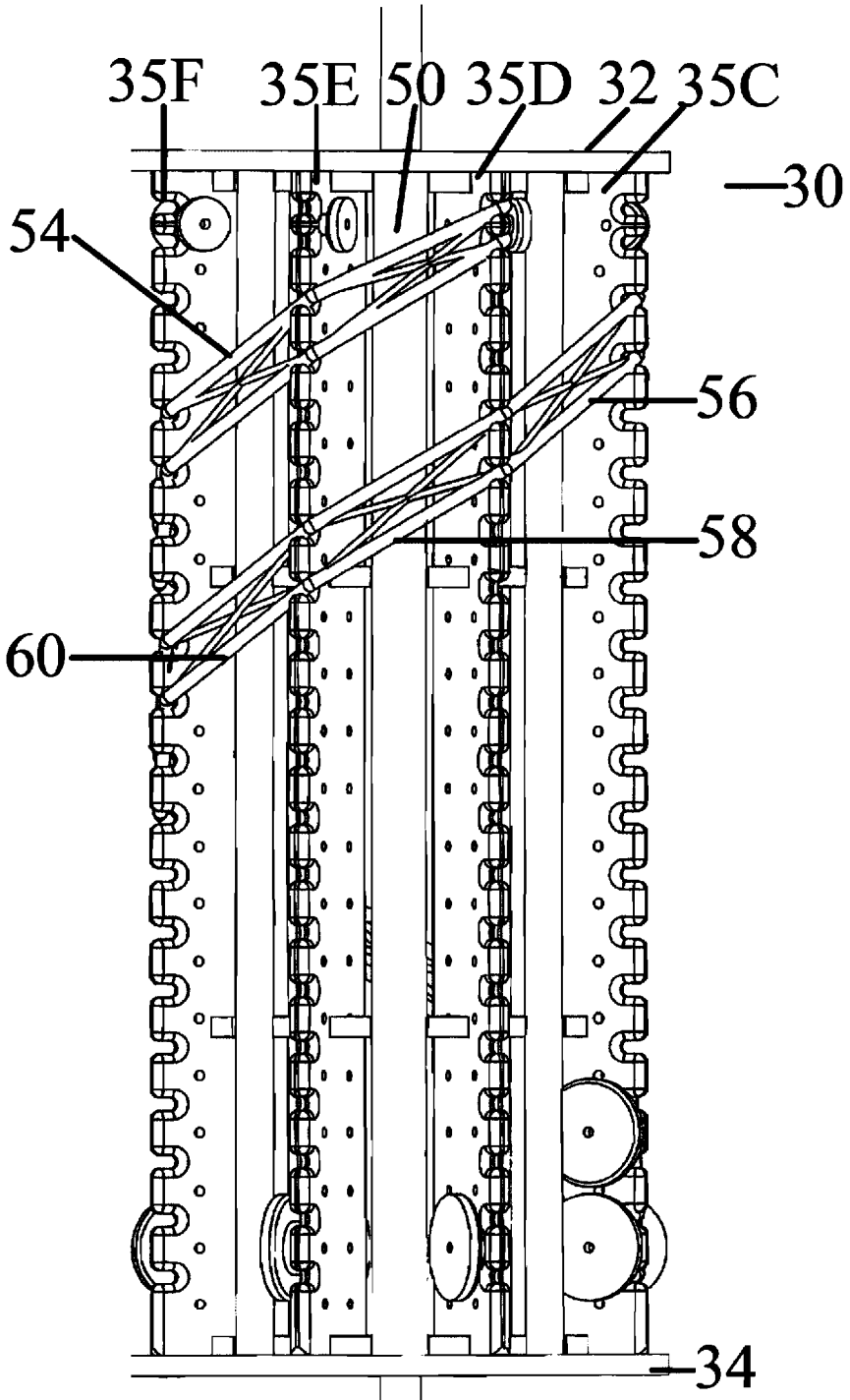
FIG. 12 is a side rear view of FIG. 10.

Referring to FIGS. 10-12, illustrated is a basic manual jig used to form the basalt stirrup wraps. The jig 30 has a first end plate 32 separated from a second end plate 34 by a series of sleeves 35. For ease of illustration, a single sleeve 35 will be described. In the preferred embodiment, the jig 30 will have eight sleeves 35 equally spaced apart around the end plates 32, 34; the end plates 32, 34 approximating the diameter of a finished piling. For instance, a 12"×12" square steel reinforced concrete piling 100 may be rehabbed into a 15" round basalt reinforced concrete piling. The sleeve 35 has a proximal end 36 with a first bracket 38 to form a receptacle loop 63 and a distal end 40 with a second bracket 42 to form an insertion loop 61. The sleeve 35 includes a plurality of slots 44 between the proximal 36 and distal end 40, and a plurality of apertures 46. The apertures allow placement of the first and second brackets 38, 42 along the length of the sleeve 35 for making as few as one wrap section or as many as nine wrap sections. In the preferred embodiment, a basalt wrap is used to form the cage assembly around the longitudinal basalt rebars.

Figures 13, 14, 15:
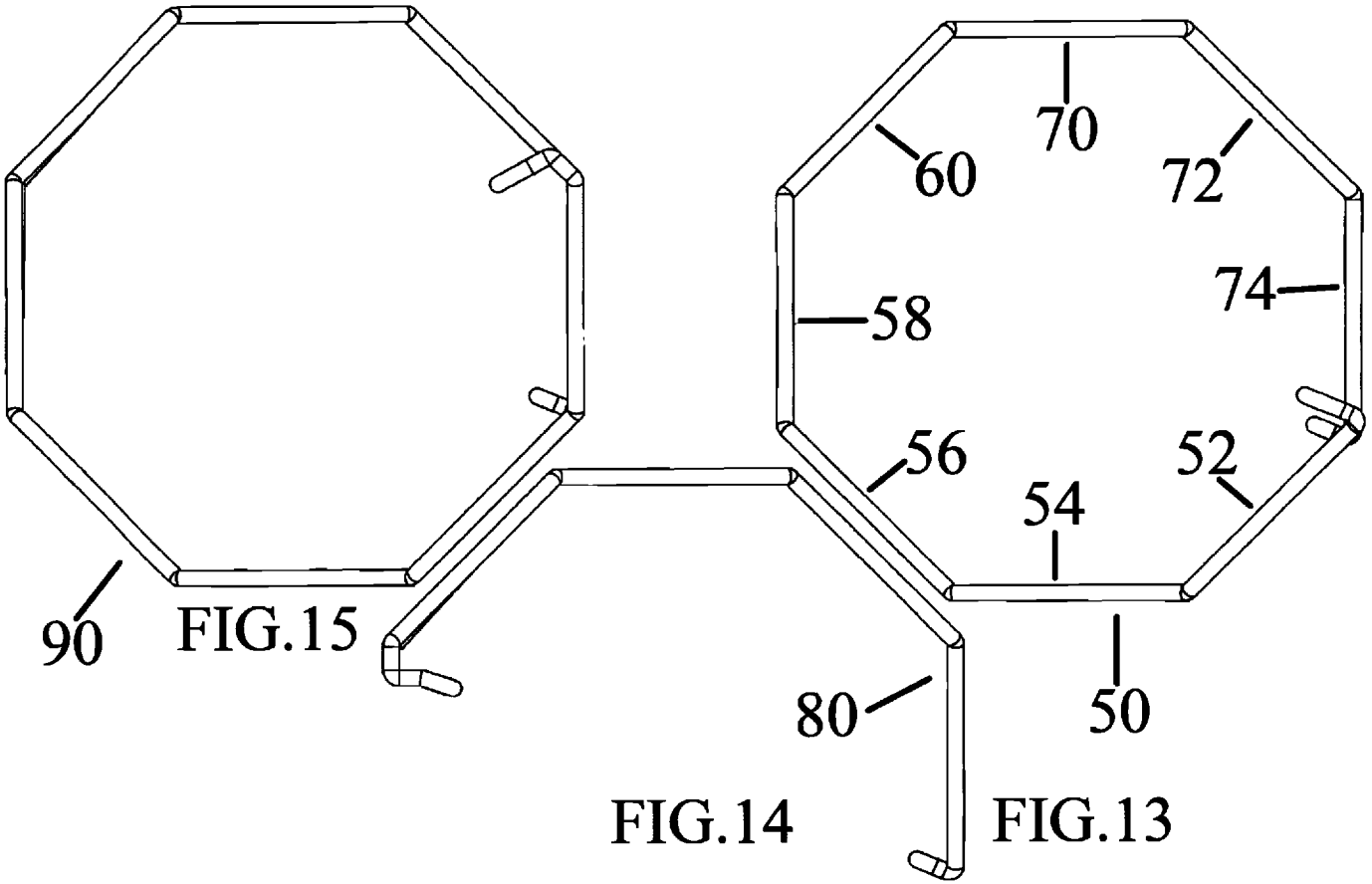
FIG. 13 is a top view of an eight section 360-degree wrap.
FIG. 14 is a top view of a nine-section wrap.
FIG. 15 is a top view of a five-section wrap.
Figure 17:
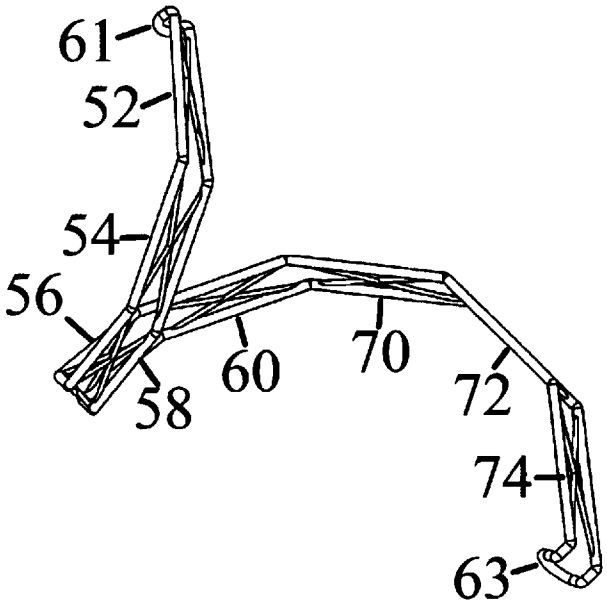
FIG. 17 is a rear side view of FIG. 16.
Figure 16:
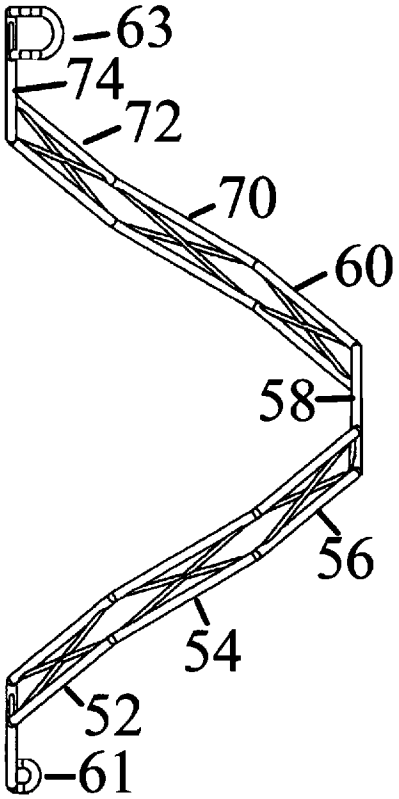
FIG. 16 is a front side view of the eight section 360-degree wrap.
Figure 18:
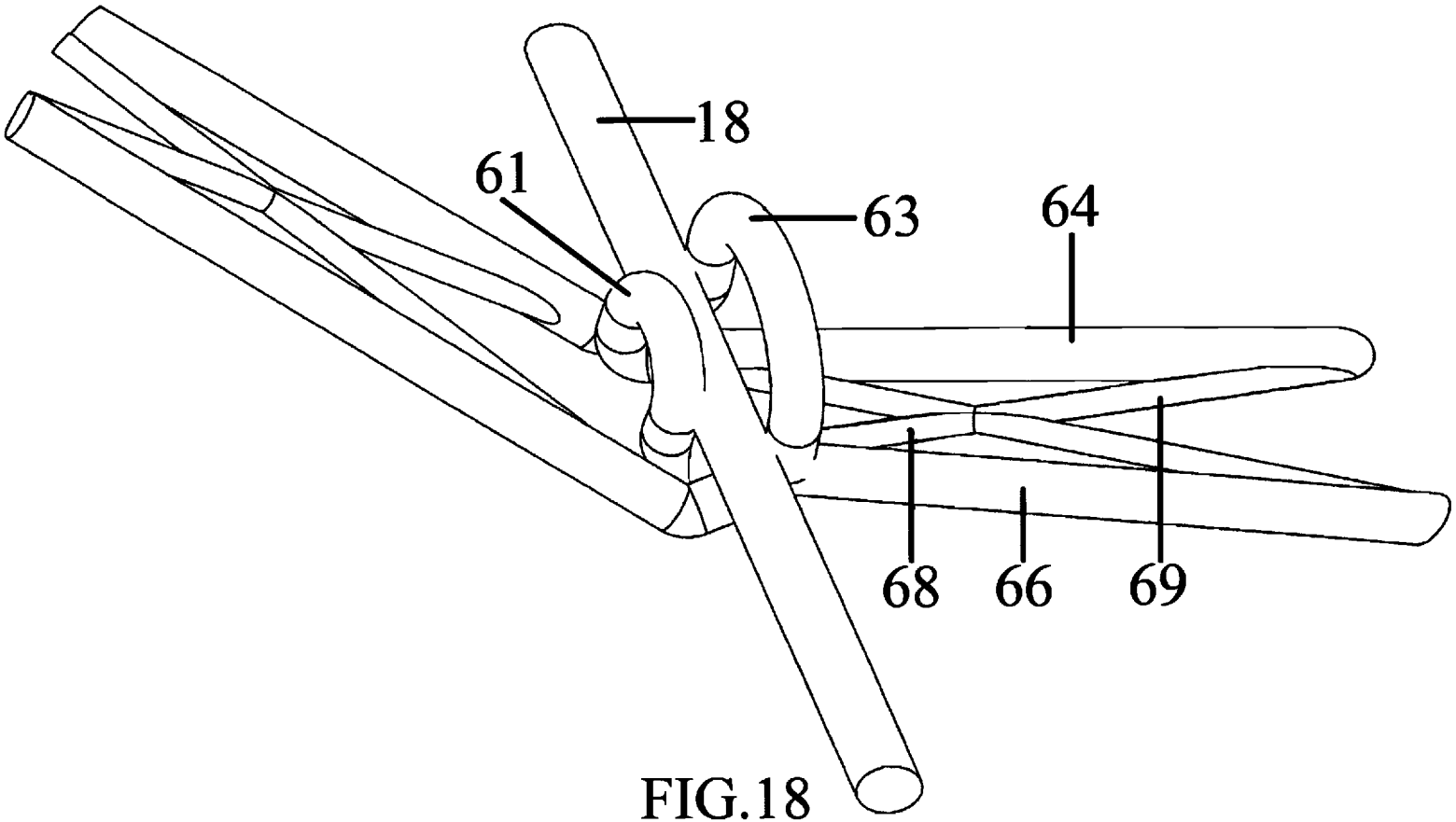
FIG. 18 is an enlarged view of an insertion end and a receptacle end engaging FRP rebar.

By way of example, a wrap 50 is made by placing fibrous material containing a fibrous material admixed with a thermosetting polymer around the first bracket 38 and engaging a slot 44 on each sleeve 35, forming a 360 degree wrap before placement around the second bracket 42. The wrap 50 continues by engaging a slot 44 on each sleeve 35 in a reverse pattern before placement around the first bracket 38. For ease of explanation, each portion of the wrap 50 between the sleeves 35 is called a wrap section. As previously stated, the wrap 50 can be as few as one wrap section or as many as ten wrap sections to form curvatures, preferably between 45 and 450 degrees. Using the wrap 50 as an example, from the first bracket 38 shown on sleeve 35A to the second sleeve 35B is considered a first wrap section 52; from the second sleeve 35B to the third sleeve 35C is considered a second wrap section 54; from the third sleeve 35C to the fourth sleeve 35D is considered a third wrap section 56; from the fourth sleeve 35D to the fifth sleeve 35E is considered a fourth wrap section 58; from the fifth sleeve 35E to the sixth sleeve 35F is considered a fifth wrap section 60, and so forth to the second bracket 42. The jig 30 can form multiple 360-degree wraps at the same time, or by moving the brackets 38, 42, can form single or a plurality of sections FIG. 13 illustrates an eight section 360 degree wrap 50 depicting sections 52, 54, 56, 58, 60, 70, 72, 74. FIG. 14 is a top view of a four section wrap 80. FIG. 15 is a top view of a nine section wrap 90. FIG. 16 is a front side view of the eight section 360-degree wrap. FIG. 17 is a rear side view of FIG. 16. FIG. 18 is an enlarged view of an insertion end 61 and receptacle end 63 engaging basalt rebar 18. In the preferred embodiment, the basalt wraps 50 has a first strand 64 spaced apart by a second strand 66 by cross links 68 and 69, see FIG. 18.

Referring to the Figures in general, in a preferred embodiment the basalt cage is constructed and arranged for placement around a 12-inch square piling 100; the method of rehabbing comprises the steps of:

Step 1, cutting a plurality of FRP longitudinal rebars 10, 12, 14, 16, 18, 20, 22 and 24 to a predetermined length having a bottom end 26 and a top end 28;

Step 2, placing the basalt longitudinal rebars 10, 12, 14, 16, 18, 20, 22 and 24 in vertical placement around the piling 100;

Step 3, forming a plurality of basalt wraps 50, each basalt wrap having an insertion end 61 spaced apart from a receptacle end 63 by a cage section 112 constructed and arranged to provide a 360 degree drape around the longitudinal rebars with the receptacle end 63 and the insertion end 61 placed in a common vertical plane;

Step 4, positioning a lower basalt wrap around the plurality of longitudinal rebars, the lower base wrap insertion end 61 placed along the bottom end of one the basalt longitudinal rebar;

Step 5, coupling an adjoining basalt wrap to the lower basalt wrap by interlocking an insertion end 61 into the receptacle end 63 of the lower basalt wrap;

Step 6, repeating Steps 4 and 5 until a basalt wrap receptacle end 63 reaches the top end 28 of a longitudinal rebar;

Step 7, repeating Steps 4, 5 and 6 until each longitudinal rebar has a wrap with an insertion end 61 and a receptacle end 63;

Step 8, tying each basalt wrap to each longitudinal rebar with plastic wire ties;

Step 9, positioning a circular shaped form 92 around the longitudinal rebars and basalt wraps, the form preferably a two pieced metal jacket with a plastic liner for ease of installation and removal;

Step 10, filling the circular shaped form 92 with liquid concrete and allowing the liquid concrete to solidify; and Step 11, removing the circular shaped form 92 from the solidified concrete.

The method forms a continuously wound uncut and without splices of secondary bonds a single, twin, triple or quad parallel spiral stirrup that is inherently cross braced to insure dimensional stability and capable of being placed at least 360 degrees around a solid object such as a column from the side and without the need for end access.

Figure 19:
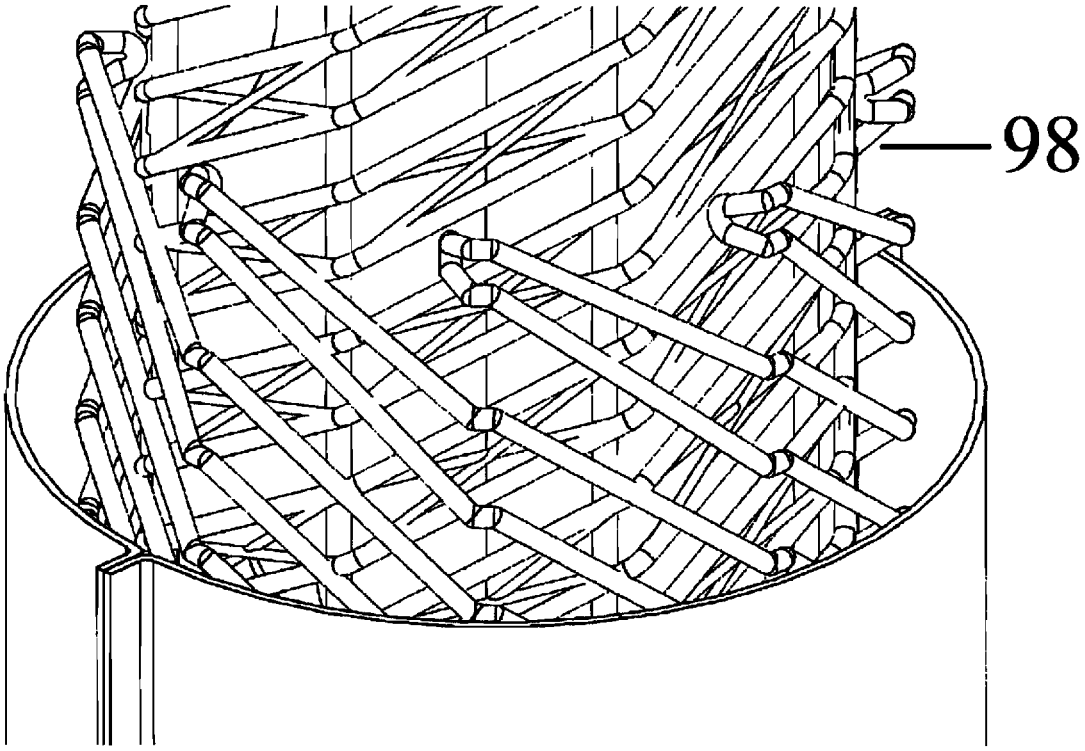
FIG. 19 is an illustration of a increased roving count.

FIG. 19 illustrates the ability to infinitely adjust the girth of containment cage spirals. Twin continuously wound parallel assemblies 98 of FRP reinforcement can be adjusted in strength by increasing or decreasing roving count, which is defined as individual fiber tendons grouped into an assembly. Further during a wet wrap fiber polymer manufacture process, the instant invention teaches a method to cause the plurality of continuous fiber roving's wound into each spiral stirrup to slide over one another. This action is possible because of the short low friction coating system that allows the fibers and roving the linear freedom to consistently adjust and balance between the roving's and tendon as they are wound thereby mitigating issues of over tension and buckling of tendon groups and subsequently, balance loading between each consecutive wrap of the FRP fibers, roving or roving group around the tooling designed to position size and shape of the twin parallel containment stirrup. In addition, tooling for the production of the FRP spiral containments can be adjusted to control the width of the spacing between the parallel bar sections of the spiral cage assemblies of FRP reinforcement. The result is a method to provide installers with control over the shear strength with the reinforced concrete piling itself. The method allows the material to be wound in both clockwise and counterclockwise directions making it possible to produce a biaxial containment reinforcement cage.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way but may also be configured in ways that are not listed.

What is claimed is:

1. A method of rehabbing a steel reinforced concrete (RC) piling comprising the steps of:

cutting a plurality of fiber reinforced polymer (FRP) longitudinal rebars to a predetermined length and vertically position and loosely secure said FRP longitudinal rebars with a tie around an existing RC piling to be rehabbed;

create a new or remediate the existing RC piling using a plurality of preformed FRP wraps, position the first preformed FRP wrap around said FRP longitudinal rebars in the shape of spiral stirrups to form a full 360 degree lateral containment cage each with a male and female end, beginning with a male end down, a plurality of said FRP wraps are placed around said FRP longitudinal rebars with each FRP wrap providing an uncut continuous circumference wrap of at least 360 degrees with overlap covering up to 450 degrees around the existing RC piling and rotating said spiral stirrup wrap into a parallel alignment with the existing RC piling and roughly aligning notches of each spiral stirrup to position and evenly space apart said FRP longitudinal rebar;

vertically positioning each male and female end of each said FRP wrap and tying each FRP longitudinal rebar to the alignment notches preformed into each said spiral stirrup FRP wrap;

continue adding lateral containment spiral stirrup sections formed by said FRP wrap as required to achieve the desired density of stirrup containment then continue in linear directions by connecting male and female insertion end spaced apart from a receptacle end assemble wrap end to end to straddle around said FRP longitudinal rebar at a position at the center of each splice wherein said FRP longitudinal rebar is constructed and arranged to operate as a joint locking pin;

placing a two-piece form constructed of plastic around said FRP longitudinal rebars and said FRP wraps; and filling said form with liquid concrete and allowing said liquid concrete to solidify.

2. The method of rehabbing a concrete steel reinforced piling according to claim 1, wherein said longitudinal FRP rebars are selected from #3-10 mm through #8-25 mm diameter rebar providing a fully scalable system to any achievable FRP rebar diameters.

3. The method of rehabbing a concrete steel reinforced piling according to claim 1, wherein each said FRP longitudinal rebar is of predetermined length calculated between a first end, where said RC piling is embedded into the earth, to a second end extending above anticipated high tide level.

4. The method of rehabbing a concrete steel reinforced piling according to claim 1, wherein each said FRP longitudinal rebar is formed from a bundle of fibrous material admixed with a thermosetting polymer selected from the group consisting of urethane, polyester, vinyl ester, epoxy, phenolic, polyimide, polyamide, polypropylene, PEEK, methacrylate, with or without graphene and or Nano enhancement or a combination thereof.

5. The method of rehabbing a concrete steel reinforced piling according to claim 4, wherein each said bundle of fibrous material is selected from the group comprising: basalt, GFRP, CFRP, AFRP or HFRP.

6. The method of rehabbing a concrete steel reinforced piling according to claim 1, wherein each said FRP wrap is formed from a bundle of fibrous material containing fibers admixed with a thermosetting polymer selected from the group consisting of urethane, polyester, vinyl ester, epoxy, phenolic, polyimide, polyamide, polypropylene, PEEK, methacrylate, with or without graphene and or Nano enhancement or a combination thereof.

7. The method of rehabbing a concrete steel reinforced piling according to claim 6, wherein each said bundle of fibrous material is selected from the group comprising: basalt, GFRP, CFRP, AFRP or HFRP.

8. The method of rehabbing a concrete steel reinforced piling according to claim 1, wherein each reinforced polymer wrap is formed from the steps comprising:

preparing a jig using (2) two to (60) sixty sleeves or notched bars placed in a circular pattern, each said sleeve having a proximal end and a distal end with a plurality of slots therebetween, at least one said sleeve including a first bracket to form a receptacle loop and a distal end with a second bracket to form an insertion loop;

immersing said fibrous material containing fibers admixed with a thermosetting or thermoplastic polymer;

placing said immersed fibrous material containing reinforced polymer around said first bracket and engaging a slot on each said sleeve to place said fibrous material into a 360 degree wrap before placement around said second bracket, and engaging a slot on each said sleeve in a reverse 360 wrap before placement around said first bracket, drying said immersed fibrous material containing fibers with a thermosetting or thermoplastic polymer to dry before removal from said jig, forming a flexible reinforced polymer wrap.

9. The method of rehabbing a steel, concrete, steel reinforced concrete, wood or plastic piling according to claim 1, wherein at least one 360-degree reinforced polymer wrap having an insertion end spaced apart from a receptacle end, said 360 degree reinforced polymer wrap constructed and arranged to allow placement from the side and without the need for end access to completely encircle a piling 360 degrees with the potential for at least 45 degrees of conference overlap when mounted from a position perpendicular to said piling.

10. The method of rehabbing a concrete steel reinforced piling according to claim 1, including the step of removing marine growth from said RC piling before placement of said longitudinal reinforced polymer rebars.

11. The method of rehabbing a concrete steel reinforced piling according to claim 1 wherein tooling is constructed and arranged to control the width of spacing between parallel bar sections of a spiral cage assembly for predictability of shear strength.

12. The method of rehabbing a concrete steel reinforced piling according to claim 1 wherein said lateral containment spiral sections can be wound in both a clockwise and counterclockwise direction.

13. The method of rehabbing a concrete steel reinforced piling according to claim 12 wherein said lateral containment spiral sections can be wound to produce a biaxial containment reinforcement cage.

14. The method of rehabbing a concrete steel reinforced piling according to claim 1, wherein said step of forming a plurality of reinforced polymer wraps include the steps of:

forming an insertion end on a first end and a receptacle end on a second end of each said reinforced polymer wrap, wherein each adjoining wrap having either a cooperating insertion end for coupling to said receptacle end, or a cooperating receptacle end for coupling to said insertion end.

* * * * *